US012013204B2

(12) United States Patent
Shamblen et al.

(10) Patent No.: US 12,013,204 B2
(45) Date of Patent: Jun. 18, 2024

(54) ARCHERY BOW ECCENTRICS AND RELATED APPARATUSES

(71) Applicant: Hoyt Archery, Inc., Salt Lake City, UT (US)

(72) Inventors: Kevin T. Shamblen, West Jordan, UT (US); Brian L. Gold, Stansbury, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 0 days.

(21) Appl. No.: 17/733,467

(22) Filed: Apr. 29, 2022

(65) Prior Publication Data

US 2023/0349661 A1 Nov. 2, 2023

(51) Int. Cl.
*F41B 5/10* (2006.01)
*F41B 5/14* (2006.01)

(52) U.S. Cl.
CPC ..... *F41B 5/105* (2013.01); *F41B 5/1411* (2013.01)

(58) Field of Classification Search
CPC .... F41B 5/10; F41B 5/105; F41B 5/14; F41B 5/1403; F41B 5/1434; Y10S 124/90
USPC ..... 124/25.6, 900
See application file for complete search history.

(56) References Cited

U.S. PATENT DOCUMENTS 6,082,346 A * 7/2000 Andrews ..... F41B 5/10 124/900
6,250,293 B1 * 6/2001 Andrews ..... F41B 5/10 124/900
RE37,544 E * 2/2002 Darlington ..... F41B 5/10 124/900
6,360,735 B1 * 3/2002 Larson ..... F41B 5/105 124/900
6,516,790 B1 * 2/2003 Darlington ..... F41B 5/10 124/900
6,691,692 B1 * 2/2004 Adkins ..... F41B 5/10 124/900
6,871,643 B2 * 3/2005 Cooper ..... F41B 5/10 124/900
6,990,970 B1 * 1/2006 Darlington ..... F41B 5/10 124/900
6,994,079 B1 * 2/2006 Darlington ..... F41B 5/10 124/900
7,305,979 B1 * 12/2007 Yehle ..... F41B 5/105 124/25.6
7,997,259 B2 * 8/2011 Wilson ..... F41B 5/105 124/25.6

(Continued)

*Primary Examiner* — Alexander R Niconovich
(74) *Attorney, Agent, or Firm* — DORSEY & WHITNEY LLP

(57) ABSTRACT

An archery bow can include a member that is adjustable or replaceable relative to a cam assembly. The member can be affixed to the cam assembly such that the member contacts one or more cables while the archery bow is in a fully drawn or near-fully drawn state. The member can be adjustable, replaceable, swappable, or otherwise modifiable to contact particular portions of the cable disposed at various distances from an axis of rotation about which the cam assembly is rotating. While in a first configuration, the member can contact a portion of the cable that is a first distance from the axis of rotation. While in a second configuration, the member can be replaced or repositioned to contact a portion of the cable that is a second distance from the axis of rotation.

20 Claims, 13 Drawing Sheets

(56) References Cited

U.S. PATENT DOCUMENTS

| | | | | |
|---|---|---|---|---|
| 8,006,679 | B2 * | 8/2011 | Strother | F41B 5/1411 124/900 |
| 8,220,446 | B2 * | 7/2012 | Batdorf | F41B 5/10 124/25.6 |
| 8,544,456 | B2 * | 10/2013 | Grace | F41B 5/10 124/900 |
| 8,671,925 | B2 * | 3/2014 | Grace | F41B 5/10 124/900 |
| 8,960,173 | B2 * | 2/2015 | Okupniak | F41B 5/105 124/900 |
| 9,097,486 | B1 * | 8/2015 | Huang | F41B 5/1403 |
| 9,121,658 | B1 * | 9/2015 | Darlington | F41B 5/123 |
| 9,146,070 | B2 * | 9/2015 | Langley | F41B 5/1434 |
| 9,261,321 | B2 * | 2/2016 | Yi | F41B 5/105 |
| 9,335,114 | B2 * | 5/2016 | Yi | F41B 5/105 |
| 9,347,730 | B2 * | 5/2016 | Obteshka | F41B 5/10 |
| 9,441,907 | B1 * | 9/2016 | Obteshka | F41B 5/105 |
| 9,581,407 | B2 * | 2/2017 | Yi | F41B 5/105 |
| 10,260,833 | B1 * | 4/2019 | Rinker | F41B 5/105 |
| 10,274,282 | B2 * | 4/2019 | Derus | F41B 5/1403 |
| 10,718,590 | B2 * | 7/2020 | Dorn | F41B 5/1403 |
| 2004/0003806 | A1 * | 1/2004 | Blahnik | F41B 5/105 124/25.6 |
| 2006/0174859 | A1 * | 8/2006 | Andrews | F41B 5/105 124/25.6 |
| 2015/0345890 | A1 * | 12/2015 | McPherson | F41B 5/1469 124/25.6 |
| 2023/0074333 | A1 * | 3/2023 | Wilson | F41B 5/105 |
| 2024/0085140 | A1 * | 3/2024 | Hyde | F41B 5/1403 |

* cited by examiner

ARCHERY BOW ECCENTRICS AND RELATED APPARATUSES

TECHNICAL FIELD

The present disclosure generally relates to archery equipment and specifically relates to incorporating an adjustable component into a cam assembly of archery equipment.

BACKGROUND

Bowhunters and other archers use finely tuned archery equipment to launch arrows and other projectiles down range. For example, compound bows include one or more eccentrics or cam assemblies which rotate as the archer draws the archery bow to bend or flex limbs of the archery bow. While bent or flexed, the limbs of the archery bow provide potential energy transferred to the projectile through the bowstring when the projectile is launched. The design and features of the cam assembly can affect the archer's shooting experience and ultimately impact the performance of the archery bow. Accordingly, there is a constant need for improvements to various types of archery equipment, such as, the functionality and performance of cam assemblies.

SUMMARY

One aspect of the present disclosure relates to an archery bow which can include a riser, a first limb coupled to a first end of the riser, a second limb coupled to a second end of the riser, a first cam assembly, a second cam assembly, a member, a bowstring, a first cable, and a second cable. The first cam assembly can be coupled to the first limb and rotatable about a first axis of rotation. The first cam assembly can include a first cam and a first module. The second cam assembly can be coupled to the second limb and rotatable about a second axis of rotation. The second cam assembly can include a second cam and a second module. The member is configured to couple to the first cam assembly in a first configuration and couple to the second cam assembly in a second configuration. The bowstring can extend between the first cam assembly and the second cam assembly. In the first configuration, the member can be configured to contact the first cable at a first distance from the first axis of rotation. In the second configuration, the member can be configured to contact the second cable at a second distance from the second axis of rotation. The first distance can be different from the second distance.

In some examples, the member can be coupled to the first module in the first configuration and coupled to the second module in the second configuration. In some examples, the member is a first member and the archery bow further comprises a second member that is coupled to the second module in the first configuration and coupled to the second module in the second configuration. In the first configuration, the second member can be configured to contact the second cable at the first distance from the second axis of rotation. In the second configuration, the second member can be configured to contact the first cable at the second distance from the first axis of rotation.

In some examples, the first distance can be less than the second distance. In some examples, the first distance can be greater than the second distance. The first cam assembly can be coupled to the first limb by a first axle defining the first axis of rotation. The second cam assembly can be coupled to the second limb by a second axle defining the second axis of rotation. In some examples, the member can be configured to be coupled to the first module or the second module by a fastener. In some examples, the member comprises a damper configured to contact the first cable or the second cable while the archery bow is in a fully drawn state. In the first configuration, the member can be repositionable relative to the first module along an axis that is substantially perpendicular to the first axis of rotation. In the second configuration, the member can be repositionable relative to the second module along an axis that is substantially perpendicular to the second axis of rotation.

Another aspect of the disclosure relates to an archery bow including a riser, a first limb coupled to a first end of the riser, a second limb coupled to a second end of the riser, a cam assembly, a bowstring, and a cable. The cam assembly can be coupled to the first limb and rotatable about an axis of rotation. The cam assembly can include a cam, a module, and a member configured to be coupled to the module or the cam in a first configuration and a second configuration. The bowstring can extend between the first limb and the second limb. The member can be configured to contact the cable at a first distance from the axis of rotation in the first configuration. The member can be configured to contact the cable at a second distance from the axis of rotation in the second configuration. The second distance can be different from the first distance. In some examples, a first surface of the member is oriented toward the cam in the first configuration and a second surface of the member is oriented toward the cam in the second configuration. The first surface can extend substantially parallel to the second surface.

In some examples, the archery bow can further comprise a second cable and a second cam assembly. The second cam assembly can be coupled to the second limb and rotatable about a second axis of rotation. The second cam assembly can include a second cam, a second module, and a second member. In a first configuration of the second member, the second member can be configured to contact the second cable at a third distance from the second axis of rotation. The third distance can be substantially equivalent to the first distance. In a second configuration of the second member, the second member can be configured to contact the second cable at a fourth distance from the second axis of rotation. The fourth distance can be substantially equivalent to the second distance.

In some examples, the member is repositionable along an axis that extends perpendicular to the cable while the archery bow is in a fully drawn state. In some examples, the member includes indicia formed on a surface of the member. The indicia can correlate to one of the first configuration or the second configuration.

Yet another aspect of the present disclosure relates to a cam assembly for an archery bow. The cam assembly includes a cam, a module, and a member. The cam can be configured to couple to the archery bow and rotate about an axis of rotation. The member can be coupled to the cam or the module. In a first configuration, the member can be configured to contact a component of an archery bow at a first distance from the axis of rotation. In a second configuration, the member can be configured to contact the component at a second distance from the axis of rotation.

In some examples, the member can be configured to be rotated or revolved to transition between the first configuration and the second configuration. In some examples, the member contacts the component while the archery bow is in a fully drawn state. In some examples, the component is a cable, a limb, or a structure affixed to the limb.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
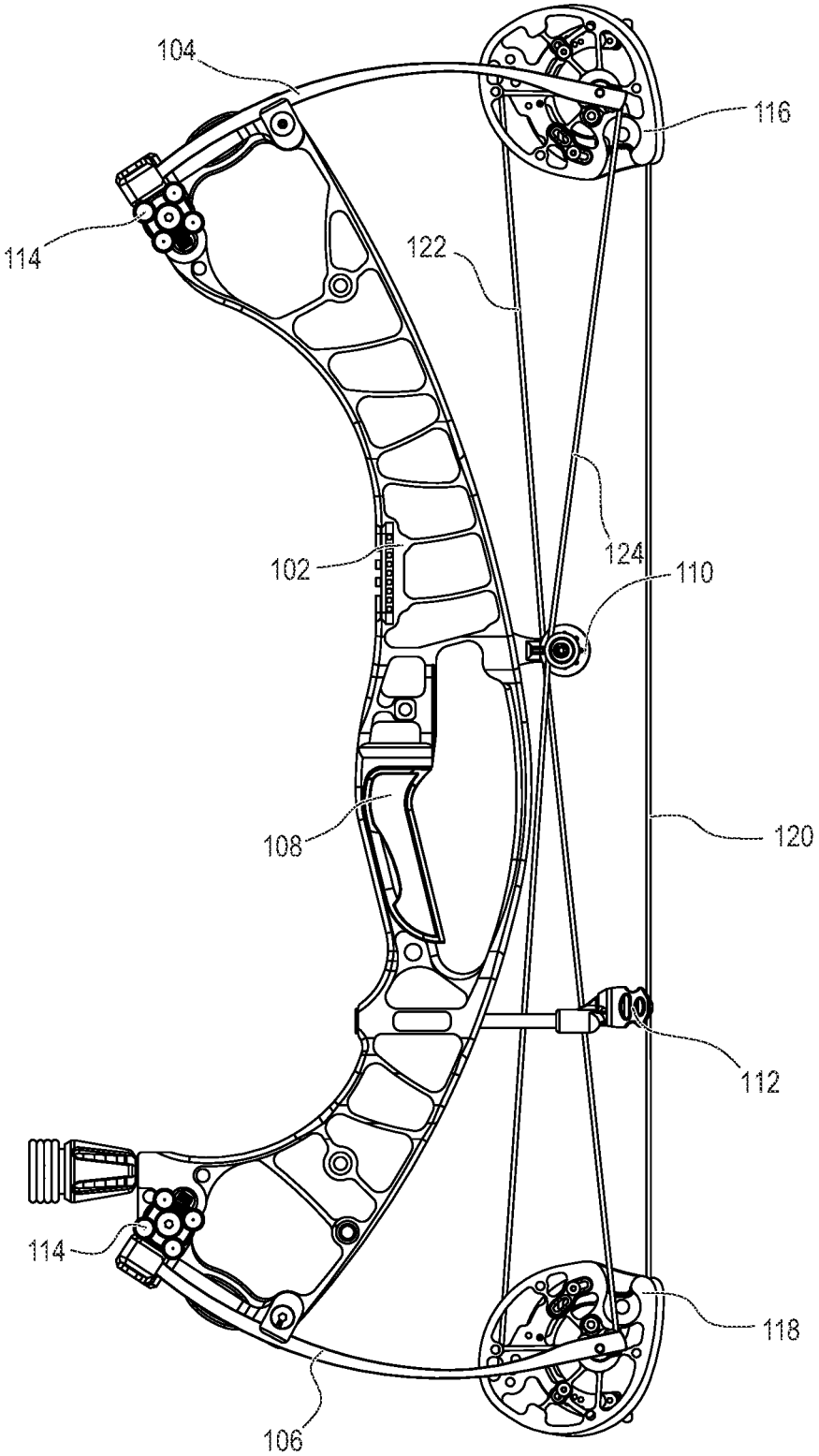
FIG. 1 is a perspective view of an archery bow.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to incorporating a member that is adjustable or replaceable into a cam assembly of an archery bow. The member can be affixed to the cam assembly such that the member contacts one or more cables while the archery bow is in a fully drawn or near-fully drawn state (i.e., when a bowstring of the archery bow is pulled by the archer to a full draw position). In some examples, the member can be adjustable, replaceable, swappable, or otherwise modifiable to contact particular portions of the cable disposed at various distances from an axis of rotation about which the cam assembly is rotating. For example, the cam assembly can rotate about an axis of rotation defined or formed by an axle extending through the cam assembly. While in a first configuration, the member can contact a portion of the cable that is a first distance from the axis of rotation. While in a second configuration, the member can be replaced or repositioned to contact a portion of the cable that is a second distance from the axis of rotation.

An archer's desired draw length (i.e., a fully drawn state of the archery bow) can be defined as a draw length of the archery bow when the draw weight is increased by a particular quantity beyond a minimum draw weight associated with a near-fully drawn state of the archery bow. See FIG. 2D and FIG. 2G. For example, a draw weight of an archery bow can decline to a minimum drawn weight $M_1$ at a near-fully drawn state $DL_1$ and build or stack to the minimum drawn weight $M_1$ plus one pound of draw weight to reach a fully drawn state $DL_2$ when the archer continues to pull the bowstring beyond the near-fully drawn state $DL_1$. See FIG. 2D. In other words, the draw weight experienced by the archer can decrease as the bowstring approaches the near-fully drawn state $DL_1$ but subsequently increase as the archer continues pulling the bowstring past the near-fully drawn state $DL_1$. In some examples, a distance between the axis of rotation and the portion of the cable that is contacted by the member while the archery bow is in a near-fully drawn state $DL_1$ can be associated with or correlate to a rate at which the archery bow increases or stacks in draw weight after the minimum draw weight $M_1$ is achieved (i.e., after the near-fully drawn state $DL_1$ is reached).

This concept is sometimes referred to as the firmness of the back wall of the archery bow. A firm back wall can limit or minimize an increase in draw length beyond the archer's desired draw length and therefore limit or prevent additional and undesired energy from being stored by the archery bow. A relatively flexible back wall can enable the archer to minimally draw the bowstring beyond the archer's desired draw length and thereby marginally increase energy stored by the archery bow. An adjustable back wall (e.g., a mechanism for controlling the rate at which the draw weight increases as additional draw length is added) can be desirable by archers to tune the archery bow to launch arrows and other projectiles down range in a more repeatable and consistent manner.

In one aspect of the present disclosure, the archery bow can include an upper cam assembly rotatably coupled to an upper limb and a lower cam assembly rotatably coupled to a lower limb. The upper cam assembly can include a first member and the lower cam assembly can include a second member. In a first configuration, the first member can be fastened or otherwise affixed to the upper cam assembly and the second member can be fastened or otherwise affixed to the lower cam assembly. When the archery bow is in a fully drawn state, the first member can contact a portion of a cable a first distance from an axis of rotation about which the upper cam assembly rotates. When the archery bow is in a fully drawn state, the second member can contact a portion of a cable the first distance from an axis of rotation about which the lower cam assembly rotates. In a second configuration, the first and second members can be swapped such that the first member is fastened or otherwise affixed to the lower cam assembly and the second member is fastened or otherwise affixed to the upper cam assembly. In the second configuration, the first member can contact a portion of a cable a second distance from the axis of rotation about which the lower cam assembly rotates and the second member can contact a portion of a cable the second distance from the axis of rotation about which the upper cam assembly rotates. The first and second distances can be dissimilar to enable the archer to modify or alter the back wall (i.e., stack rate) of the archery bow.

According to another aspect of the present disclosure, the archery bow can include an upper cam assembly rotatably coupled to an upper limb. The upper cam assembly can include a member that can be flipped or rotated to vary a distance from an axis of rotation of the upper cam assembly at which the member contacts a cable. In a first configuration, the member can be fastened or otherwise affixed to the upper cam assembly and contact a portion of a cable a first distance from the axis of rotation about which the upper cam assembly rotates when the archery bow is in a fully drawn state. In a second configuration, the member can be, removed from the upper cam assembly, flipped or rotated, and re-affixed to the upper cam assembly. In the second configuration, the member can contact a portion of the cable at a second distance from the axis of rotation about which the upper cam assembly rotates when the archery bow is in a fully drawn state. The first and second distances can be dissimilar to enable the archer to modify or alter the back wall (i.e., stack rate) of the archery bow. For example, the second distance can be less than the first distance such that the second distance provides a less rigid back wall.

Additionally, or alternatively, the archery bow can include a lower cam assembly rotatably coupled to a lower limb. The lower cam assembly can include a respective member (i.e., different from the member associated with the upper cam assembly) that can be flipped or rotated to vary a distance at which the member contacts a cable. In a first configuration, the member can be fastened or otherwise affixed to the lower cam assembly and contact a portion of a cable a first distance from an axis of rotation about which the lower cam assembly rotates when the archery bow is in a fully drawn state. In a second configuration, the member can be, removed from the lower cam assembly, flipped or rotated, and re-affixed to the lower cam assembly. In the second configuration, the member can contact a portion of the cable at a second distance from the axis of rotation about which the lower cam assembly rotates when the archery bow is in a fully drawn state. The first and second distances can be dissimilar to enable the archer to modify or alter the back wall (i.e., stack rate) of the archery bow.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, features described with respect to certain embodiments may be combined in other embodiments.

Referring now to the figures in detail, FIG. 1 shows a compound archery bow 100. The bow 100 is at a rest position (e.g., a brace state or brace position). The bow 100 can comprise a riser 102 from which one or more upper limbs 104 and one or more lower limbs 106 extend. The bow 100 can include a grip 108, a roller guard or cable guard 110, a string-stop damper 112, dampers 114, and other parts and accessories commonly known in the art.

The upper limbs 104 may be connected to an upper cam assembly 116, and the lower limbs 106 may be connected to a lower cam assembly 118. A bowstring 120 (i.e., draw string) may extend across the length of the bow 100 between the upper cam assembly 116 and the lower cam assembly 118 when the bow 100 is positioned vertically upright in a normal shooting orientation. The terminal ends of the bowstring 120 may be attached to and held entrained to the cam assemblies 116, 118, at least in the brace position, and the limbs 104, 106 may be flexed to store energy and retain tension in the bowstring 120. A first cable 122 and a second cable 124 may also be attached to and extend between the upper cam assembly 116 and the lower cam assembly 118. Collectively, the first cable 122 and the second cable 124 may be referred to herein as the cables of the bow 100. The first and second cables 122, 124 may retain tension in the limbs 104, 106 and cam assemblies 116, 118 and may be controlled to adjust tension in the bowstring 120, draw length of the bowstring 120, and other tuning features of the bow 100.

The figures illustrate example archery apparatuses that may be used in conjunction with the principles and teachings of the present disclosure. Thus, while the archery bows described herein are compound bows, it will be understood by those having ordinary skill in the art that the components of the archery bow, accessories, and related methods and apparatuses included in embodiments of the present disclosure may be applied to components and apparatuses in compound bows, crossbows, their accessories, and other equipment related archery. Similarly, archery equipment applying the teachings of the present disclosure does not need to implement all of the features of the present disclosure. For example, in some embodiments, the bow may not comprise a cable guard 110 or a string-stop damper 112, so features associated with those accessories may be omitted from the bow.

When shooting an arrow, the tail end of the arrow may be nocked with the bowstring 120 at a nocking point while the bow 100 is in the brace position shown in FIG. 1. The bowstring 120 may be drawn rearward to a full draw position, thereby partially unraveling the bowstring 120 from the outer grooves of the cam assemblies 116, 118. The archer may grasp grip 108 of the riser 102 and draw back the bowstring 120 (e.g., by using a well-known D-loop). As the limbs 104, 106 flex inward and the cables 122, 124 wind around the cam assemblies 116, 118, the cables 122, 124 may slide along or may be in rolling contact with portions of the cable guard 110, which may comprise at least one roller or other smooth support in contact with the cables 122, 124 where they contact the cable guard 110.

When the bowstring 120 is released, the potential/stored energy in the limbs 104, 106 is released, and the bowstring 120 quickly accelerates back toward the brace position (shown in FIG. 1) as it applies a shooting force to an end of the projectile (e.g., an arrow). As the limbs 104, 106 release their energy, the cam assemblies 116, 118 are spread apart, and the terminal ends of the bowstring 120 wrap around the cam assemblies 116, 118, and the cables 122, 124 unwind from the cam assemblies 116, 118. A portion of the bowstring 120 may contact the string-stop damper 112, which can help dampen vibrations in the bowstring 120, and the cables 122, 124 may roll or slide against the cable guard 110 as the cams 116, 118 move.

Figure 2A:
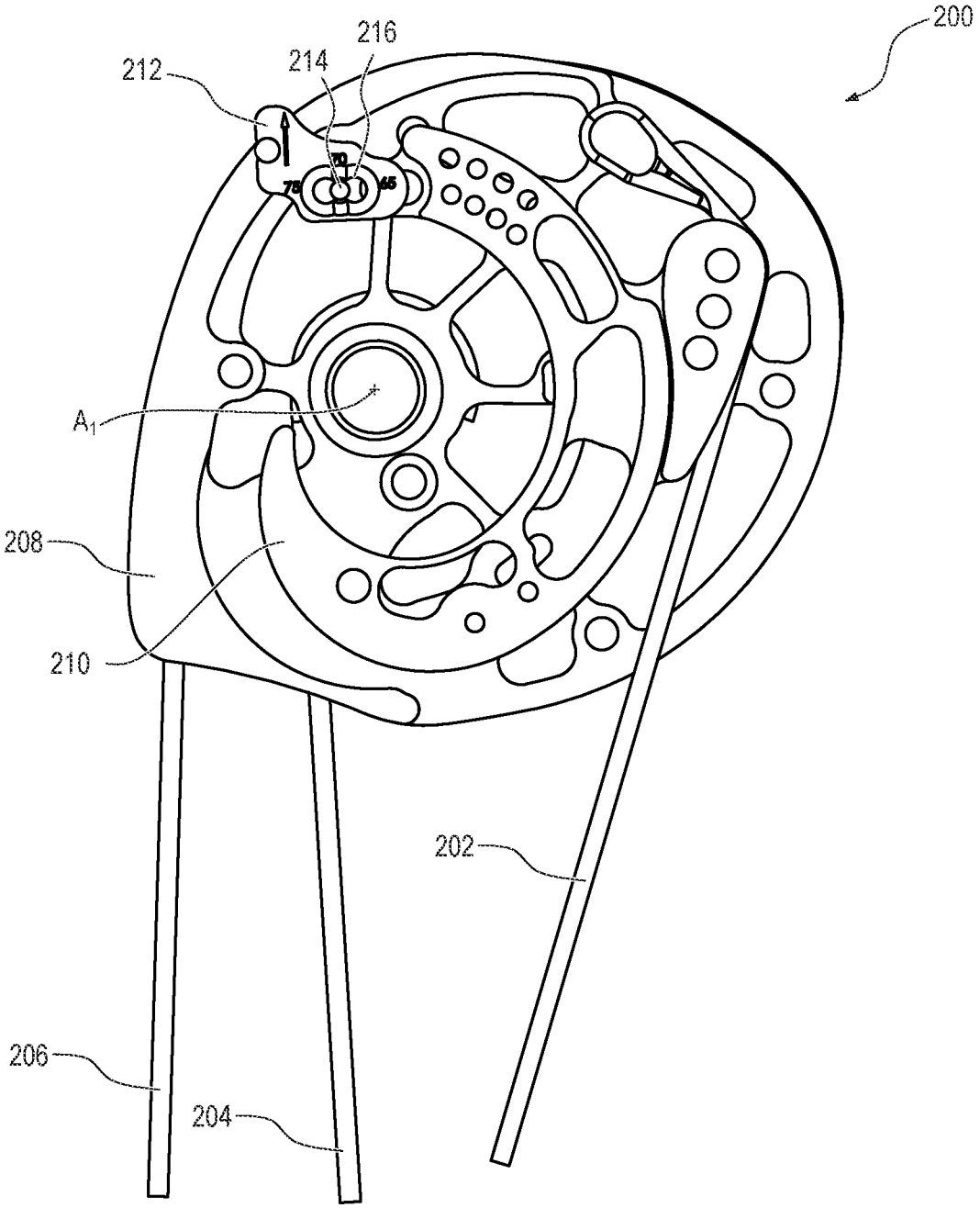
FIG. 2A is a detail side view of a cam assembly in a first configuration with the archery bow is in a brace state, according to some embodiments.

FIG. 2A shows a side view of a cam assembly 200, a first cable 202, a second cable 204, and a bowstring 206 while the archery bow is in a brace state, according to one aspect of the present disclosure. The cam assembly 200 can include a cam 208, a module 210, and a member 212. The cam assembly 200 can rotate about an axis of rotation $A_1$, for example, an axle (not shown) can be extended through one or more limbs (see FIG. 1) and the cam assembly 200 such that the cam assembly 200 rotates relative to the limb about the axle when the archery bow transitions between a brace state and a fully drawn state. The cam 208 can include a groove or track (not shown) and the bowstring 206 can be at least partially disposed within the groove or track. In some examples, the module 210 can be repositioned on the cam 208 to vary a draw length or other characteristic of the archery bow. For example, the module 210 can be fastened to the cam 208 in one of a plurality of circumferential positions about the axis of rotation $A_1$. The module 210 can include a groove or track (not shown) and the first cable 202 can be at least partially disposed within the groove or track while the archery bow is in a fully drawn state. The cam 208 and module 210 can be machined, molded, stamped, or otherwise formed from one or more of a metal, a polymer, a ceramic, a combination thereof, or any other material.

In some examples, the member 212 can be fastened to the module 210 such that a position of the member 212 relative to the cam 208 can be varied based on the position of the module 210 relative to the cam 208. For example, the module 210 can include a threaded through-hole 214 or other feature capable of receiving a fastener (not shown) extending through the member 212 to couple the member 212 to the module 210. Alternatively, or additionally, the member 212 can be fastened to the cam 208 in one of a plurality of radial positions. In some examples, the fastener can extend through a slot 216 formed within the member 212. The slot 216 can enable the member 212 to be repositionable along the length of the slot 216.

Figure 2B:
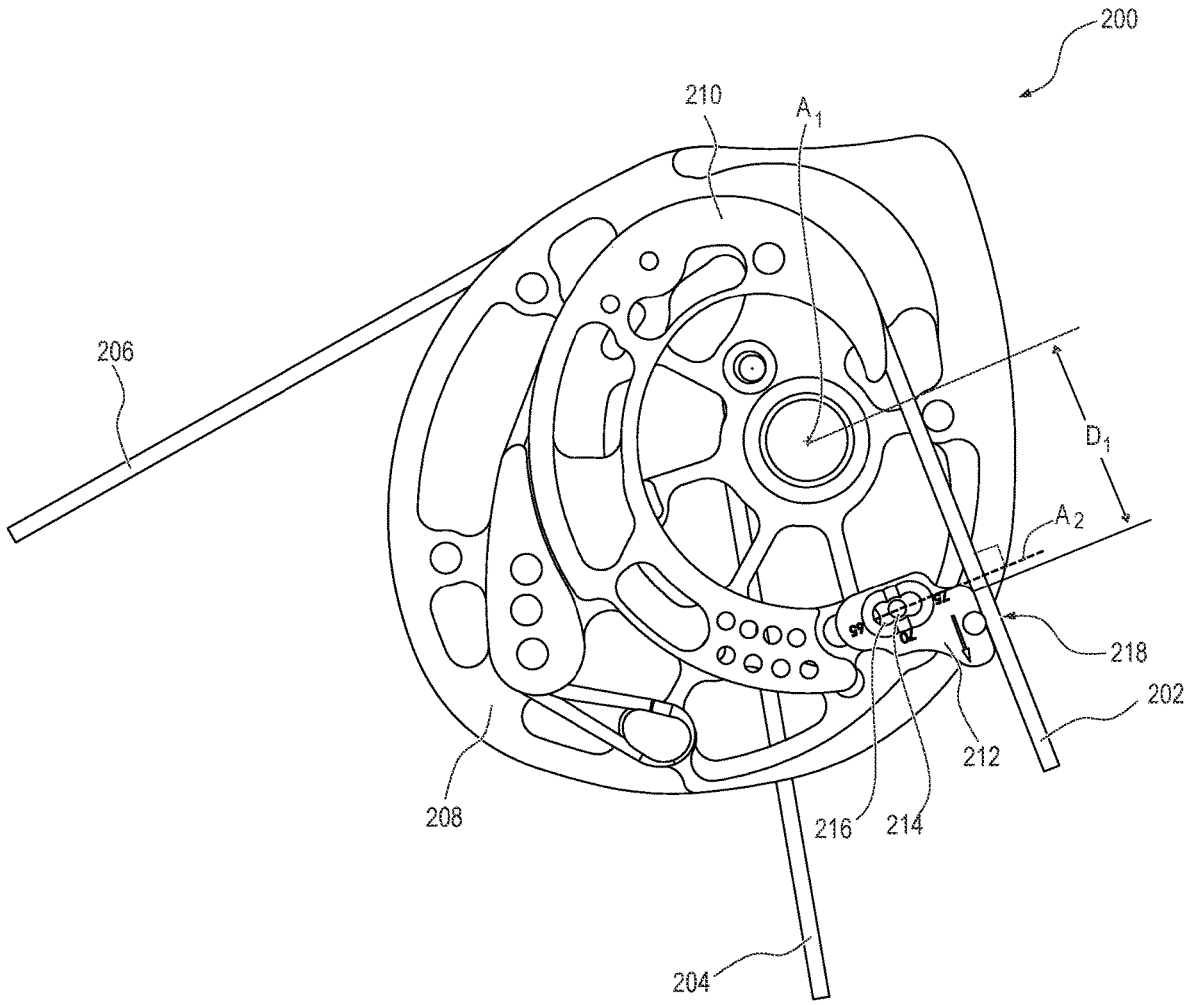
FIG. 2B is a detail side view of the cam assembly in the first configuration with the archery bow is in a fully drawn state, according to some embodiments.

FIG. 2B shows a side view of the cam assembly 200, the first cable 202, the second cable 204, and the bowstring 206 while the archery bow is in a fully drawn state. While transitioning from the brace state (see FIG. 2A) to the fully drawn state (see FIG. 2B), the archer can pull the bowstring 206 such that the first cable 202 is taken up within a track/groove formed in the module 210 while the bowstring 206 and second cable 204 are let out of respective tracks/grooves formed on the cam 208. In the fully drawn state, the member 212 can contact a portion of the first cable 202 to prevent continued rotation of the cam assembly 200 about the axis of rotation $A_1$. In other words, the member 212 can rotate with the cam assembly 200 about the axis of rotation $A_1$ and contact the first cable 202 to impede rotation of the cam assembly 200 beyond a desired orientation.

In some examples, the member 212 can contact a portion 218 of the first cable 202 that is displaced or separated from the axis of rotation $A_1$ by a distance $D_1$. The distance $D_1$ between the portion 218 and the axis of rotation $A_1$ (i.e., a distance the member 212 is offset from the axis of rotation $A_1$) can be less than about 10 millimeters (mm), between about 10 mm and about 20 mm, between about 20 mm and about 30 mm, between about 40 mm and about 50 mm, or greater than about 50 mm.

Figure 2C:
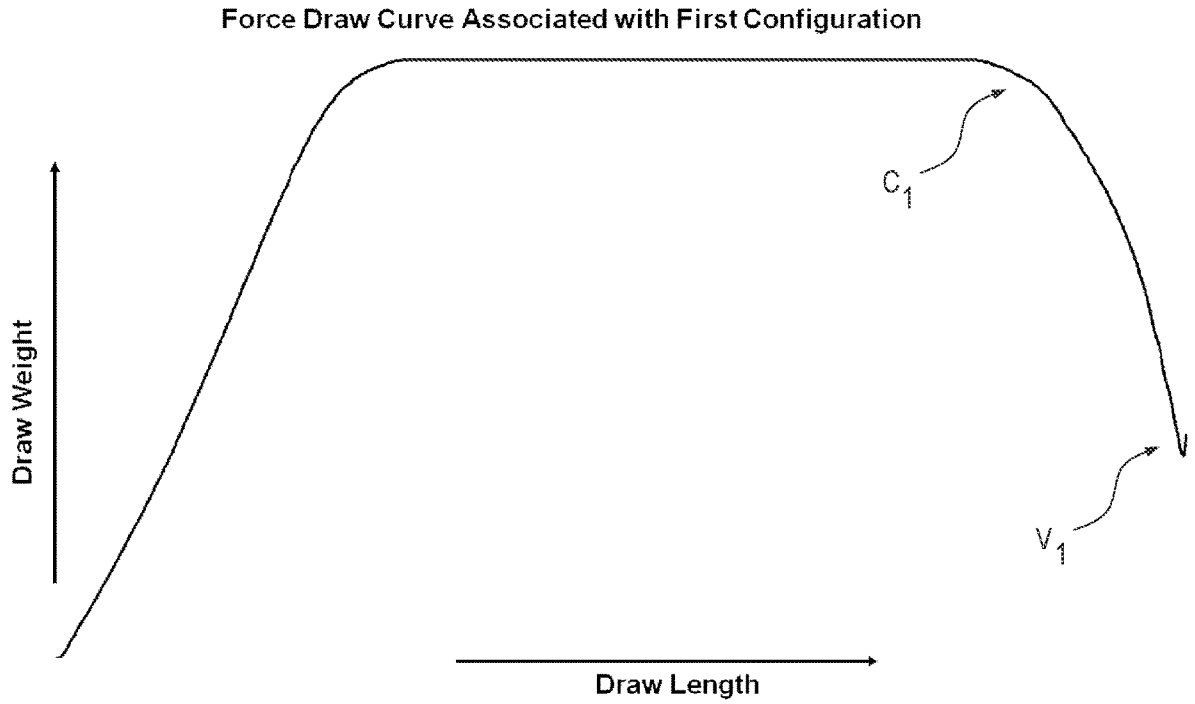
FIG. 2C is a force draw curve correlating to the cam assembly of FIG. 2B, according to some embodiments.
Figure 2D:
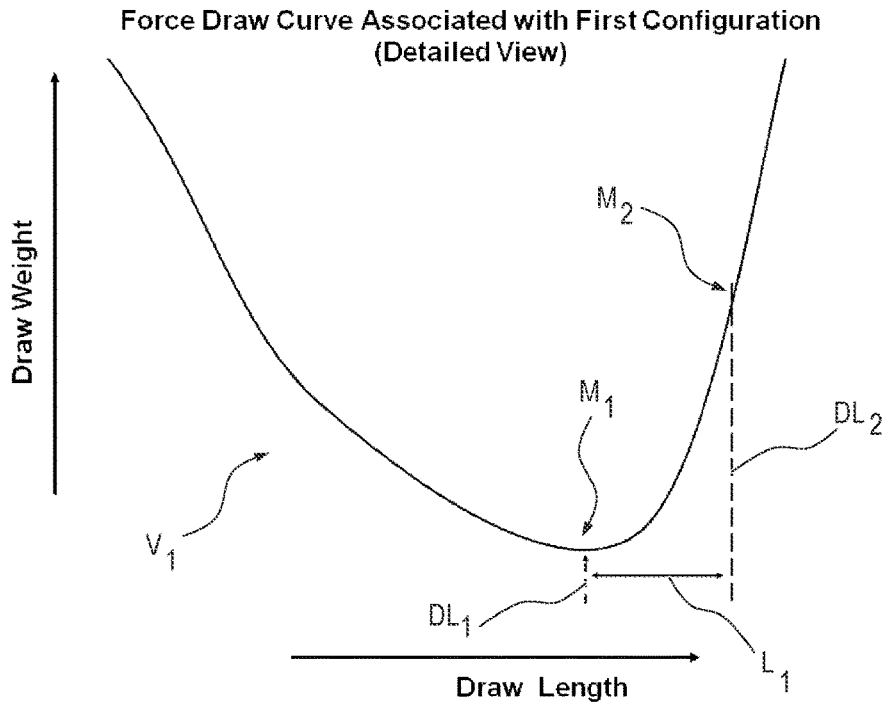
FIG. 2D is a detailed view of the valley of the force draw curve shown in FIG. 2C, according to some embodiments.

FIG. 2C shows a graphical representation of a draw force curve $C_1$ associated with the cam assembly 200 in a first configuration (i.e., with the member 212 coupled to the cam assembly 200). The draw force curve $C_1$ can be represented as a function of a draw weight of the archery bow over a draw length of the archery bow. The draw force curve $C_1$ correlating to a near-fully drawn state can resemble a valley $V_1$ wherein the draw weight decreases and subsequently increases. FIG. 2D is a detail view of the valley $V_1$ shown in FIG. 2C. As the archery bow approaches a near-fully drawn state $DL_1$, the draw weight can decrease until a minimum drawn weight $M_1$ is reached. In some examples, a draw length of the archery bow (i.e., a fully drawn state $DL_2$) can be defined as the draw length associated with the near-fully drawn state $DL_1$ in combination with an ancillary draw length associated with increasing the draw weight by a particular quantity (e.g., to attain draw weight $M_2$). For example, the draw length of the archery bow in a fully drawn state $DL_2$ can be the draw length associated with the near-fully drawn state $DL_1$ along with additional draw length $L_1$ associated with increasing the minimum drawn weight $M_1$ by 1 pound (as shown in FIG. 2D).

Figure 2E:
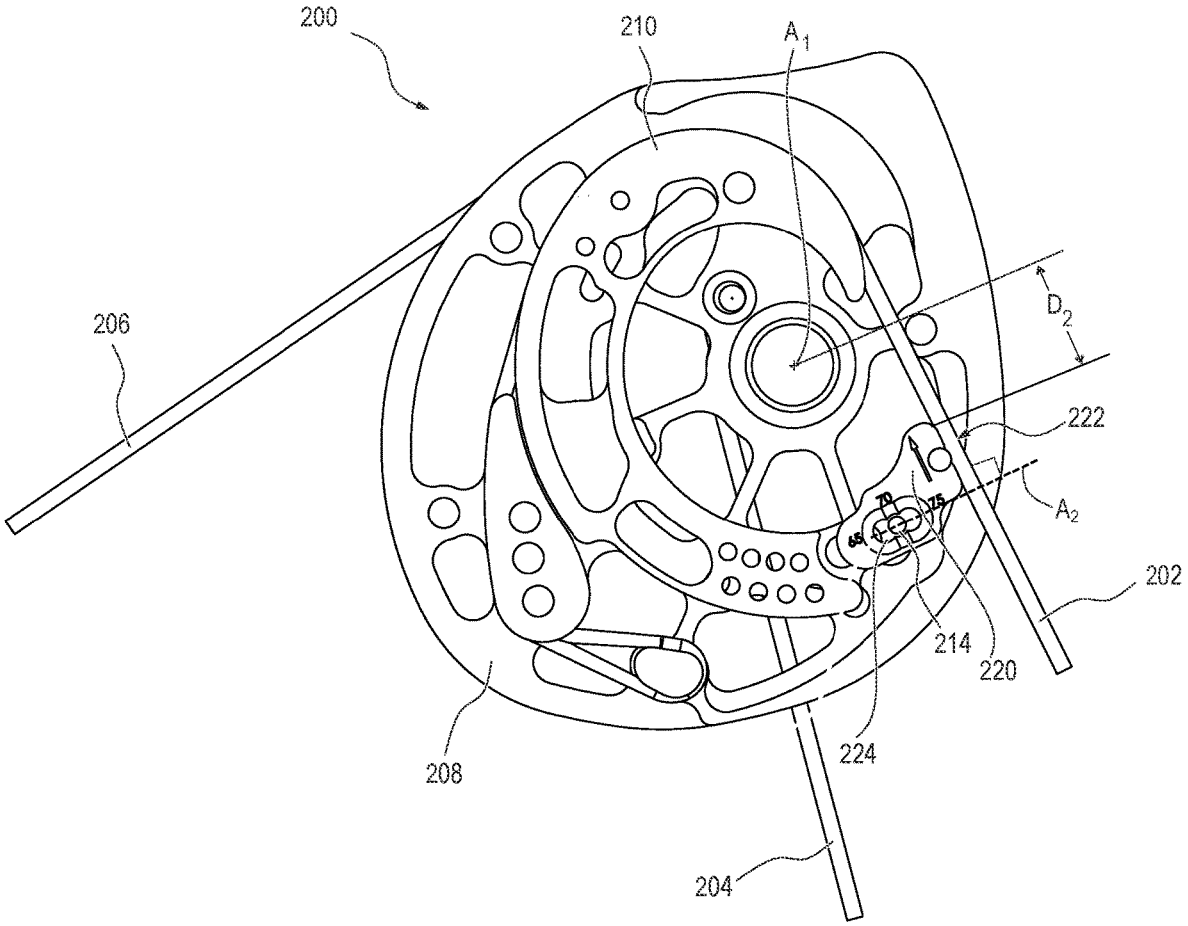
FIG. 2E is a detail side view of the cam assembly in a second configuration with the archery bow is in a fully drawn state, according to some embodiments.

In some examples, the member 212 shown in FIG. 2B can be a first member 212 that is replaceable by a second member 220 (see FIG. 2E). For example, the first member 212 can be removably fastened to the module 210 such that the first member 212 can be removed and replaced by the second member 220. As shown in FIG. 2E, in some examples, the second member 220 can contact a portion 222 of the first cable 202 that is displaced or separated from the axis of rotation $A_1$ by a distance $D_2$. The distance $D_2$ between the portion 222 and the axis of rotation $A_1$ (i.e., a distance the second member 220 is offset from the axis of rotation $A_1$) can be less than about 10 mm, between about 10 mm and about 20 mm, between about 20 mm and about 30 mm, between about 40 mm and about 50 mm, or greater than about 50 mm.

Figure 2F:
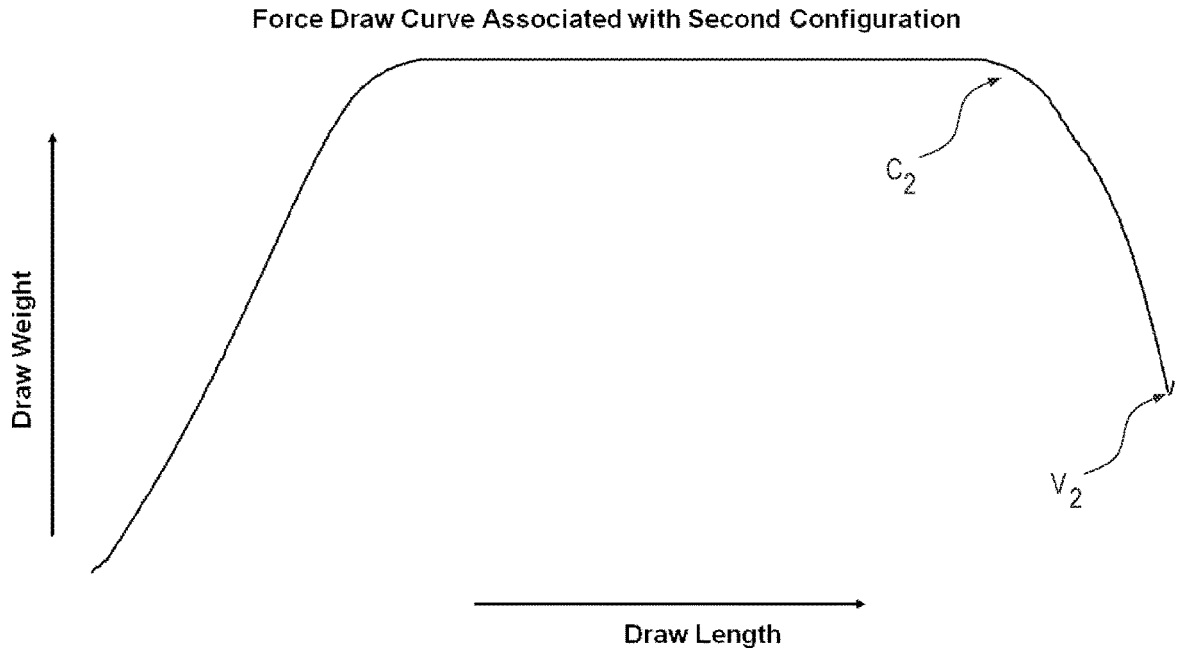
FIG. 2F is a force draw curve correlating to the cam assembly of FIG. 2E, according to some embodiments.
Figure 2G:
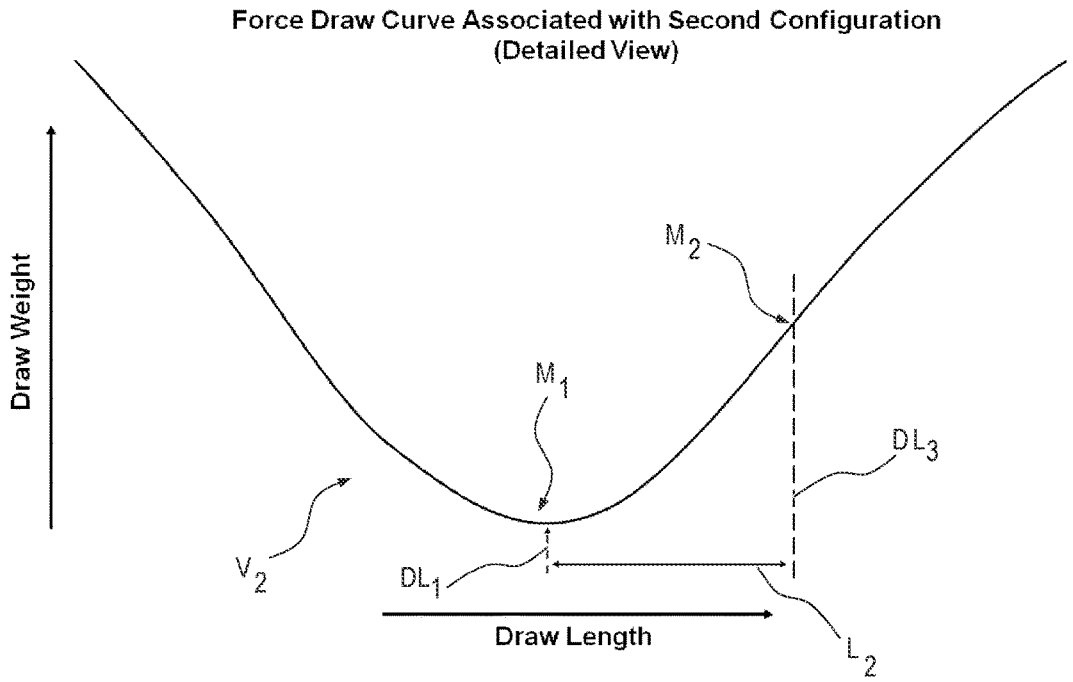
FIG. 2G is a detailed view of the valley of the force draw curve shown in FIG. 2F, according to some embodiments.

FIG. 2F shows a graphical representation of a draw force curve $C_2$ associated with the cam assembly 200 in a second configuration (i.e., with the second member 220 coupled to the cam assembly 200). The draw force curve $C_2$ can be represented as a function of a draw weight of the archery bow over a draw length of the archery bow. The draw force curve $C_2$ correlating to a near-fully drawn state can resemble a valley $V_2$ wherein the draw weight decreases and subsequently increases. FIG. 2G is a detail view of the valley $V_2$ shown in FIG. 2F. As the archery bow approaches the near-fully drawn state $DL_1$, the draw weight can decrease until the minimum drawn weight $M_1$ is reached. In some examples, a draw length of the archery bow (i.e., a fully drawn state $DL_3$) can be defined as the draw length associated with the near-fully drawn state $DL_1$ in combination with an ancillary draw length associated with increasing the draw weight by a particular quantity (e.g., to attain draw weight $M_2$). For example, the draw length of the archery bow in a fully drawn state $DL_3$ can be the draw length associated with the near-fully drawn state $DL_1$ along with additional draw length $L_2$ associated with increasing the minimum drawn weight $M_1$ by 1 pound (as shown in FIG. 2G).

In some examples, the draw length associated with the fully drawn state $DL_2$ shown in FIG. 2D can be relatively shorter than the draw length associated with the fully drawn state $DL_3$ shown in FIG. 2G. That is, the additional draw length $L_1$ associated with the first configuration can be less than the additional draw length $L_2$ associated with the second configuration. Moreover, the additional draw length $L_1$ beyond the minimum drawn weight $M_1$ can be perceived by an archer as a relatively rigid backwall while the additional draw length $L_2$ beyond the minimum drawn weight $M_1$ can be perceived by an archer as a relatively flexible or less rigid backwall.

As described herein, varying the distance (distances $D_1$, $D_2$) between the axis of rotation $A_1$ and the portion (e.g., portions 218, 222) of the first cable 202 that is contacted by the member (e.g., first or second members 212, 220) while the archery bow is in a near-fully drawn state can be associated with or correlate to a rate at which the archery bow increases or stacks in draw weight after the minimum draw weight $M_1$ is achieved. In other words, the distance (distances $D_1$, $D_2$) between the axis of rotation $A_1$ and the portion (e.g., portions 218, 222) of the first cable 202 that is contacted by the member (e.g., first or second members 212, 220) while the archery bow is in a near-fully drawn state can correlate to the additional draw length (draw lengths $L_1$, $L_2$ shown in FIGS. 2D and 2E). Thus, the first member 212 can provide a relatively more firm back wall to limit or minimize an increase in draw length $L_1$ and therefore limit or prevent additional and undesired energy from being stored by the archery bow. Conversely, the second member 220 can provide a relatively flexible back wall enabling an increase in draw length (draw length $L_2$). The adjustability provided by the first and second members 212, 220 can be desirable by archers to tune the archery bow to launch arrows and other projectiles down range in a more repeatable and consistent manner. While only two members (e.g., the first and second members 212, 220) are described above and shown in FIGS. 2A, 2B, and 2E, a single member or more than two members can be provided to contact the first cable 202 at one of a plurality of distances from the axis of rotation $A_1$.

In some examples, the first member 212 can include the slot 216 enabling the first member 212 to be fastened to the module 210 (or cam 208) along an axis $A_2$ that extends substantially perpendicular to the axis of rotation $A_1$ or otherwise extends substantially perpendicular to the portion 218 of the first cable 202 while the archery bow is in a fully drawn state. For example, the slot 216 can enable the first member 212 to be affixed to the module 210 in one of three positions which correlate to a let-off of the archery bow (i.e., a percentage of draw weight that is reduced as the archery bow is in a fully drawn state). In some examples, the archery bow has a relatively lower let-off when the first member 212 is affixed to extend further from the module 210 and toward the portion 218 of the first cable 202. In some examples, the archery bow has a relatively higher let-off when the first member 212 is affixed to minimally extend from the module 210 and toward the portion 218 of the first cable 202. In other words, the first member 212 can limit an amount of rotation of the cam assembly 200 by contacting the first cable 202 to set the amount of let-off of the archery bow. While the let-off adjustment via slot 216 was described above with reference to the first member 212, this feature is alternatively, or additionally, applicable to the second member 220. For example, the second member 220 can include a slot 224 enabling the second member 220 to be affixed to the module 210 (or cam 208) along the axis $A_2$.

Figure 2H:
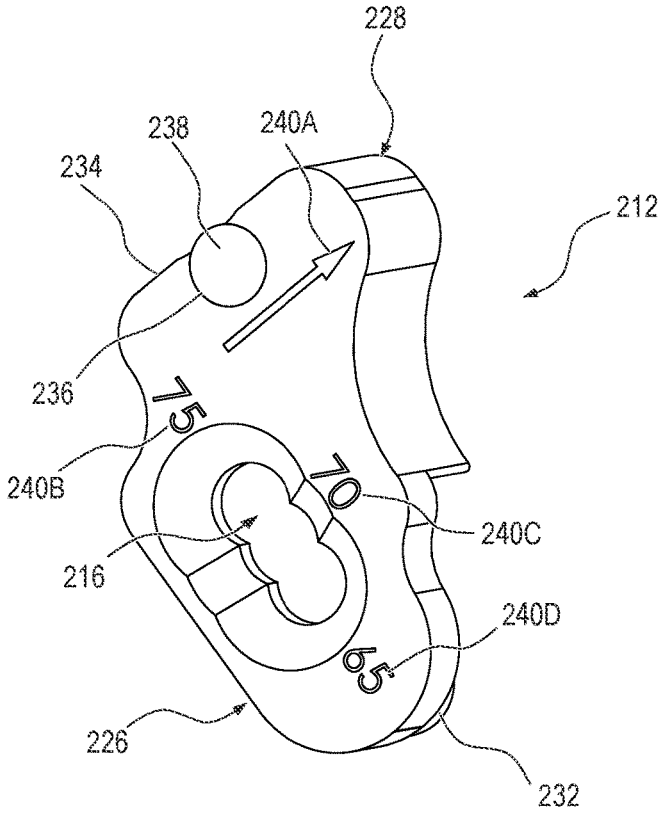
FIG. 2H is a perspective side view of a member, according to some embodiments.
Figure 2I:
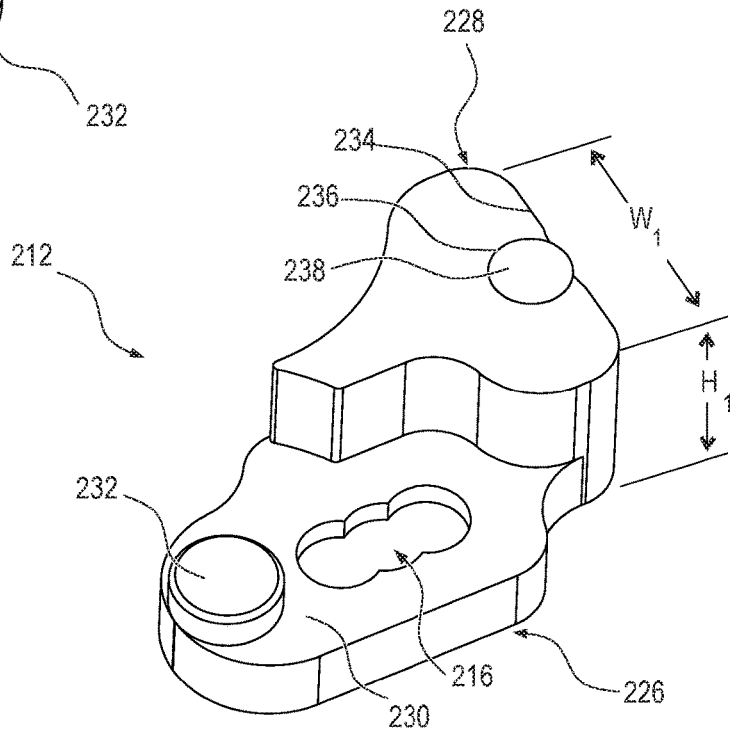
FIG. 2I is a perspective side view of the member.

FIGS. 2H and 2I show respective side views of the first member 212. In some examples, the first member 212 can include a first portion 226 and a second portion 228. The first portion 226 can be configured to couple or affix to the module 210 and/or the cam 208. The second portion 228 can be configured to contact the first cable 202. The first and second portions 226, 228 can be integrally formed or otherwise coupled together by a fastener, weld, molding, adhesive, or a combination thereof. For example, the first and second portions 226, 228 can be machined or molded from a single piece of material. In some examples, the first portion 226 can be thinner than the second portion 228 to enable the first member 212 to be affixed to the module 210 and/or cam 208 while still providing a relatively large contact surface (see planar surface 234) to interface with the first cable 202.

In some examples, the first portion 226 includes the slot 216 formed within a planar surface 230 that at least partially interfaces with the module 210 or cam 208. In some examples, the slot 216 can be chamfered, recessed, or otherwise at least partially recessed. In some examples, a protrusion 232 can extend from the planar surface 230. While the first member 212 is affixed to the module 210 and/or the cam 208, the protrusion 232 can extend into a cut-out, channel, or cavity defined by the module 210 and/or the cam 208. The protrusion 232 can orient the first member 212 in a particular orientation that enables the first member 212 to contact the first cable 202. For example, the combination of a fastener (not shown) extending through the slot 216 and the protrusion 232 can cause the second portion 228 of the first member 212 to contact the first cable 202.

In some examples, the second portion 228 can define a planar or substantially planar surface 234 that at least partially contacts the first cable 202 while the archery bow is in a fully drawn state. The planar surface 234 can have a width $W_1$ that is less than about 5 mm, between about 5 mm and about 10 mm, between about 10 mm and about 15 mm, between about 15 mm and about 20 mm, or greater than about 20 mm. The planar surface 234 can have a height $H_1$ that is less than about 3 mm, between about 3 mm and about 6 mm, between about 6 mm and about 9 mm, between about 9 mm and about 12 mm, or greater than about 12 mm.

In some examples, the cam assembly 200 can include one or more dampers. For example, the planar surface 234 of the first member 212 can include a channel or retaining feature 236 configured to have one or more dampers 238 disposed therein. The damper 238 can contact the first cable 202 while the archery bow is in a fully drawn state. Additionally, or alternatively, the planar surface 234 can contact the first cable 202 while the archery bow is in a fully drawn state. The damper 238 can include a flexible polymer that at least partially deforms while in contact with the first cable 202.

In some examples, the first member 212 can include one or more symbols or indicia 240A, 240B, 240C, 240D indicating an orientation or configuration of the first member 212. For example, the indicia 240A can be an arrow or other symbol indicative of the distance (e.g., distance $D_1$ or distance $D_2$) from the axis of rotation $A_1$ the first member 212 contacts the portion 218 of the first cable 202. For example, an arrow pointing away from the axis $A_1$ (see FIG. 2B) can indicate the first member 212 contacts the first cable 202 at the distance $D_1$ while an arrow pointing toward the axis $A_1$ (see FIG. 2E) can indicate the second member 220 contacts the first cable 202 at the distance $D_2$. In other words, the indicia 240A can indicate whether the member (e.g., the first member 212 or the second member 220) is relatively closer or further from the axis of rotation $A_1$. The indicia 240B, 240C, 240D can be indicative of a let-off position of the first member 212 to achieve an associated let-off of the draw weight at a fully drawn state of the archery bow. For example, the indicia 240B can be indicative of a 75% let-off.

Figure 2J:
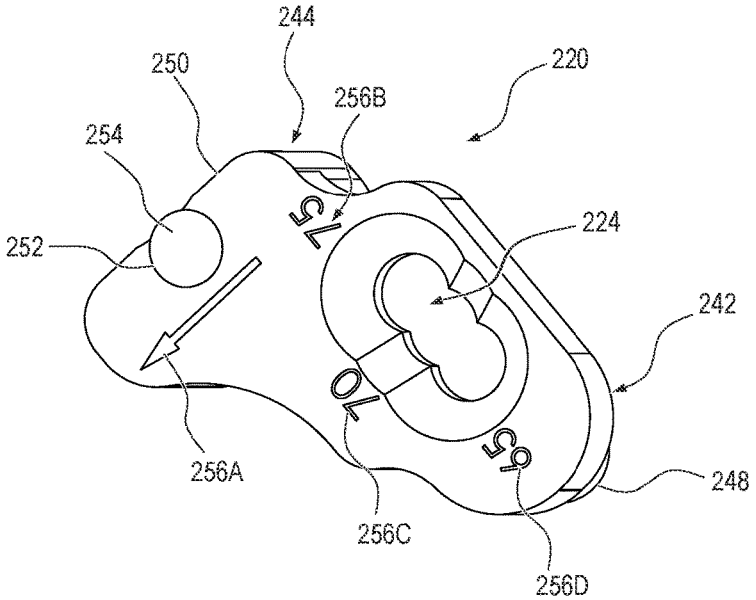
FIG. 2J is a perspective side view of a member, according to some embodiments.
Figure 2K:
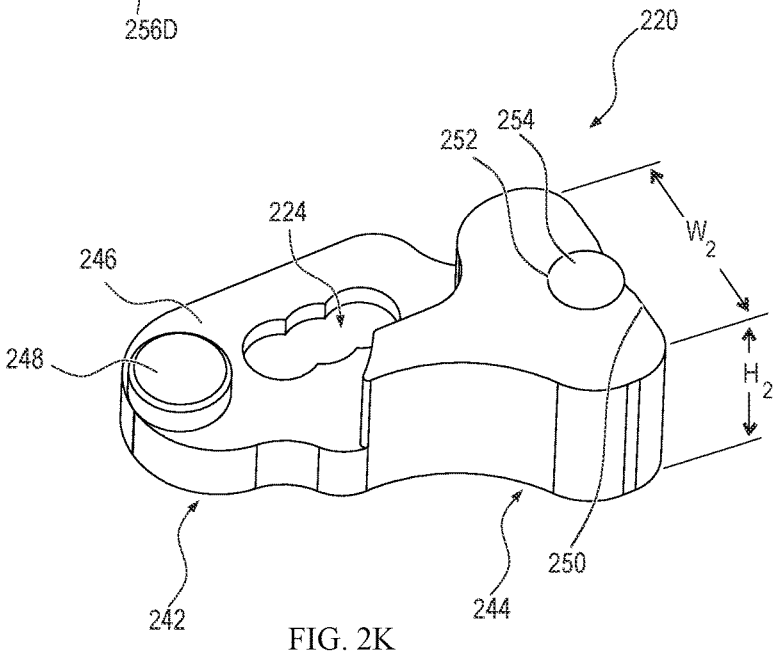
FIG. 2K is a perspective side view of the member.

FIGS. 2J and 2K show respective side views of the second member 220. In some examples, the second member 220 can include a first portion 242 and a second portion 244. The first portion 242 can be configured to couple or affix to the module 210 and/or the cam 208. The second portion 244 can be configured to contact the first cable 202. The first and second portions 242, 244 can be integrally formed or otherwise coupled together by a fastener, weld, molding, adhesive, or a combination thereof. For example, the first and second portions can be machined or molded from a single piece of material. In some examples, the first portion 242 can be thinner than the second portion 244 to enable the second member 220 to be affixed to the module 210 and/or cam 208 while still providing a relatively large contacting surface (see planar surface 250) to interface with the first cable 202.

In some examples, the first portion 242 includes the slot 224 formed within a planar surface 246 that at least partially interfaces with the module 210 or cam 208. In some examples, the slot 224 can be chamfered, recessed, or otherwise at least partially recessed. In some examples, a protrusion 248 can extend from the planar surface 246. While the second member 220 is affixed to the module 210 and/or the cam 208, the protrusion 248 can extend into a cut-out, channel, or cavity defined by the module 210 and/or the cam 208. The protrusion 248 can orient the second member 220 in a particular orientation that enables the second member 220 to contact the first cable 202. For example, the combination of a fastener (not shown) extending through the slot 224 and the protrusion 248 can cause the second portion 244 of second member 220 to contact the first cable 202.

In some examples, the second portion 244 can define a planar or substantially planar surface 250 that at least partially contacts the first cable 202 while the archery bow is in a fully drawn state. The planar surface 250 can have a width $W_2$ that is less than about 5 mm, between about 5 mm and about 10 mm, between about 10 mm and about 15 mm, between about 15 mm and about 20 mm, or greater than about 20 mm. The planar surface 250 can have a height $H_2$ that is less than about 3 mm, between about 3 mm and about 6 mm, between about 6 mm and about 9 mm, between about 9 mm and about 12 mm, or greater than about 12 mm.

In some examples, the cam assembly 200 can include one or more dampers. For example, the planar surface 250 of the second member 220 can include a channel or retaining feature 252 configured to have one or more dampers 254 disposed therein. The damper 254 can contact the first cable 202 while the archery bow is in a fully drawn state. Additionally, or alternatively, the planar surface 250 can contact the first cable 202 while the archery bow is in a fully drawn state. The damper 254 can include a flexible polymer that at least partially deforms while in contact with the first cable 202.

In some examples, the second member 220 can include one or more symbols or indicia 256A, 256B, 256C, 256D indicating an orientation or configuration of the second member 220. For example, the indicia 256A can be an arrow or other symbol indicative of the distance (e.g., distance $D_1$ or distance $D_2$) from the axis of rotation $A_1$ the second member 220 contacts the portion 222 of the first cable 202. For example, an arrow pointing away from the axis $A_1$ (see FIG. 2B) can indicate the first member 212 contacts the first cable 202 at the distance $D_1$ while an arrow pointing toward the axis $A_1$ (see FIG. 2C) can indicate the second member 220 contacts the first cable 202 at the distance $D_2$. In other words, the indicia 256A can indicate whether the member (e.g., the first member 212 or the second member 220) is relatively closer or further from the axis of rotation $A_1$. The indicia 256B, 256C, 256D can be indicative of a let-off position of the second member 220 to achieve an associated let-off of the draw weight at a fully drawn state of the archery bow. For example, the indicia 256D can be indicative of a 65% let-off.

While the first and second members 212, 220 are described as contacting respective portions of the first cable 202, in other examples, the first member 212 and/or second member 220 can contact other components of the archery bow to inhibit continued rotation of the cam assembly 200. For example, the first member 212 and/or second member 220 can contact portions of a limb (e.g., limb 104) at various distances (e.g., distances $D_1$, $D_2$) from the axis of rotation $A_1$. Additionally, or alternatively, the first member 212 and/or second member 220 can contact portions of a limb hanger or other structure, affixed to the limb (e.g., limb 104), at various distances (e.g., distances $D_1$, $D_2$) from the axis of rotation $A_1$. The first member 212 and/or second member 220 can contact any component of the archery bow to limit rotation of the cam assembly 200 beyond a desired orientation.

Figure 3A:
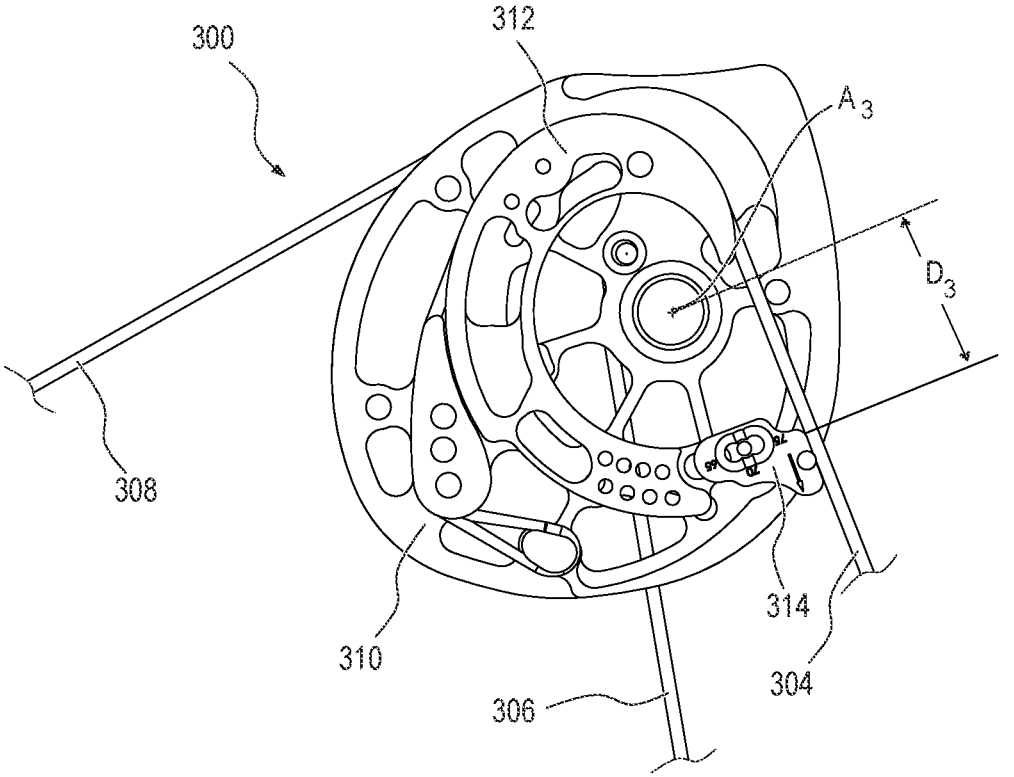
FIG. 3A is a side view of upper and lower cam assemblies in a first configuration while the archery bow is in a fully drawn state, according to some embodiments.
Figure 3A:
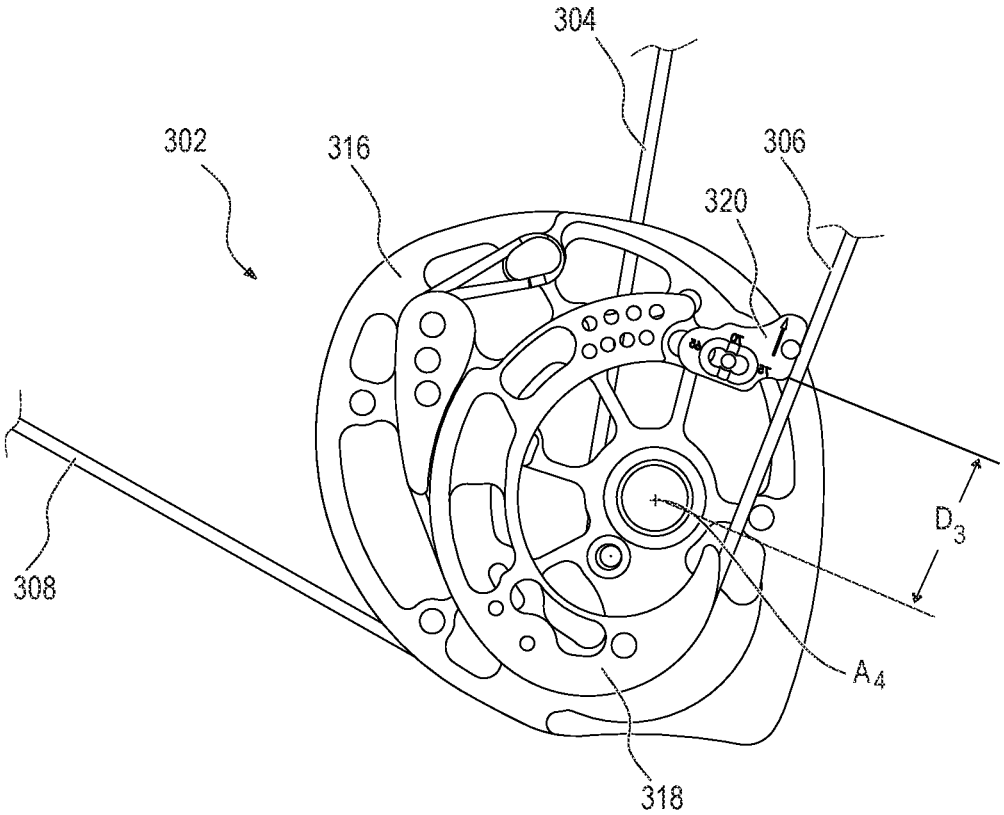
Figure 3B:
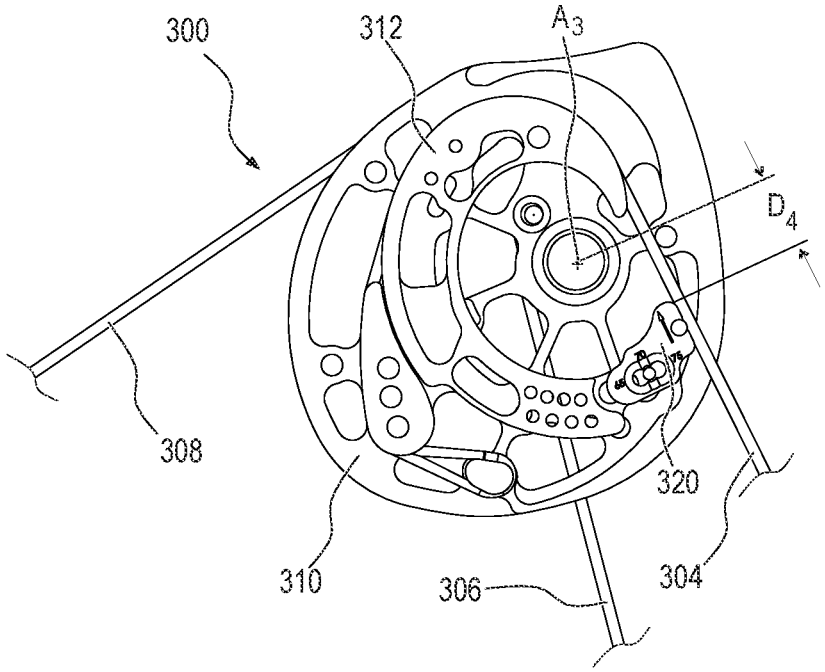
FIG. 3B is a side view of the upper and lower cam assemblies in a second configuration while the archery bow is in a fully drawn state, according to some embodiments.
Figure 3B:
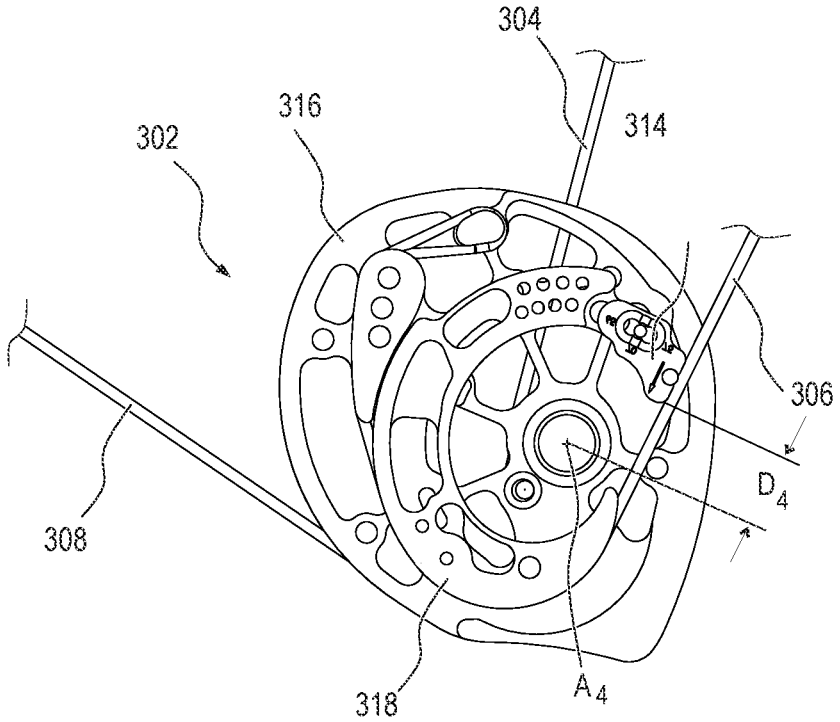

FIGS. 3A and 3B show upper and lower cam assemblies of an archery bow illustrated as tethered together by multiple cables and a bowstring. The section lines separating the upper and lower cam assemblies represent components of the archery bow disposed between the upper and lower cam assemblies, such as, additional lengths of the cables, bowstring, and a roller guard. Thus, it should be appreciated that the scale of the cam assemblies in relation to the space between the cam assemblies may not be accurately illustrated and therefore should not be considered as limiting to aspects of this disclosure. FIG. 3A shows an upper cam assembly 300, a lower cam assembly 302, a first cable 304, a second cable 306, and a bowstring 308 while the archery bow is in a fully drawn state and is in a first configuration. The upper cam assembly 300 can be substantially similar to, and can include some or all of, the features of the cam assembly 200. For example, the upper cam assembly 300 can include an upper cam 310, an upper module 312, and a first member 314. The upper cam assembly 300 can rotate about an axis of rotation $A_3$, for example, an axle (not shown) can be extended through one or more upper limbs (see FIG. 1) and the upper cam assembly 300 such that the upper cam assembly 300 is rotatable relative to the upper limb about the axle when the archery bow transitions between a brace state and a fully drawn state.

In some examples, the lower cam assembly 302 can include a lower cam 316, a lower module 318, and a second member 320. The lower cam assembly 302 can rotate about an axis of rotation $A_4$, for example, an axle (not shown) can be extended through one or more lower limbs (see FIG. 1) and the lower cam assembly 302 such that the lower cam assembly 302 is rotatable relative to the lower limb about the axle when the archery bow transitions between a brace state and a fully drawn state.

FIG. 3B shows the upper cam assembly 300, the lower cam assembly 302, the first cable 304, the second cable 306, and the bowstring 308 while the archery bow is in the fully drawn state and is in a second configuration. In the first configuration (see FIG. 3A), the first member 314 is coupled to the upper cam assembly 300 and the second member 320 is coupled to the lower cam assembly 302. In the first configuration, the first member 314 contacts the first cable 304 at a distance $D_3$ from the axis of rotation $A_3$ and the second member 320 contacts the second cable 306 at the distance $D_3$ from the axis of rotation $A_4$. In the second configuration (see FIG. 3B), the first and second members 314, 320 can be swapped such that the first member 314 is coupled to the lower cam assembly 302 and the second member 320 is coupled to the upper cam assembly 300. In the second configuration, the first member 314 contacts the second cable 306 at a distance $D_4$ from the axis of rotation $A_4$ and the second member 320 contacts the first cable 304 at the distance $D_4$ from the axis of rotation $A_3$.

In some examples, the distance $D_3$ can be greater than the distance $D_4$. In some examples, the distance $D_3$ can be less than the distance $D_4$. The distance $D_3$ can be less than about 10 mm, between about 10 mm and about 20 mm, between about 20 mm and about 30 mm, between about 40 mm and about 50 mm, or greater than about 50 mm. The distance $D_4$ can be less than about 10 mm, between about 10 mm and about 20 mm, between about 20 mm and about 30 mm, between about 40 mm and about 50 mm, or greater than about 50 mm.

As described herein, varying the distance (distances $D_3$, $D_4$) between the axis of rotation $A_3$ and the first cable 304 that is contacted by the member (e.g., first or second member 314, 320) while the archery bow is in a near-fully drawn state can be associated with or correlate to a rate at which the archery bow increases or stacks in draw weight after the minimum draw weight is achieved (i.e., after the near-fully drawn state is achieved). Thus, the first configuration (see FIG. 3A) can provide a relatively more firm back wall to limit or minimize an increase in draw length beyond the archer's desired draw length and therefore limit or prevent additional and undesired energy from being stored by the archery bow. Conversely, the second configuration (see FIG. 3B) can provide a relatively flexible back wall enabling the archer to minimally draw the bowstring beyond the archer's desired draw length and thereby marginally increasing energy stored by the archery bow. The adjustability provided by swapping the position of the first and second members 314, 320 on the upper and lower cam assemblies 300, 302 can be desirable by archers to tune the archery bow to launch arrows and other projectiles down range in a more repeatable and consistent manner.

Figure 4A:
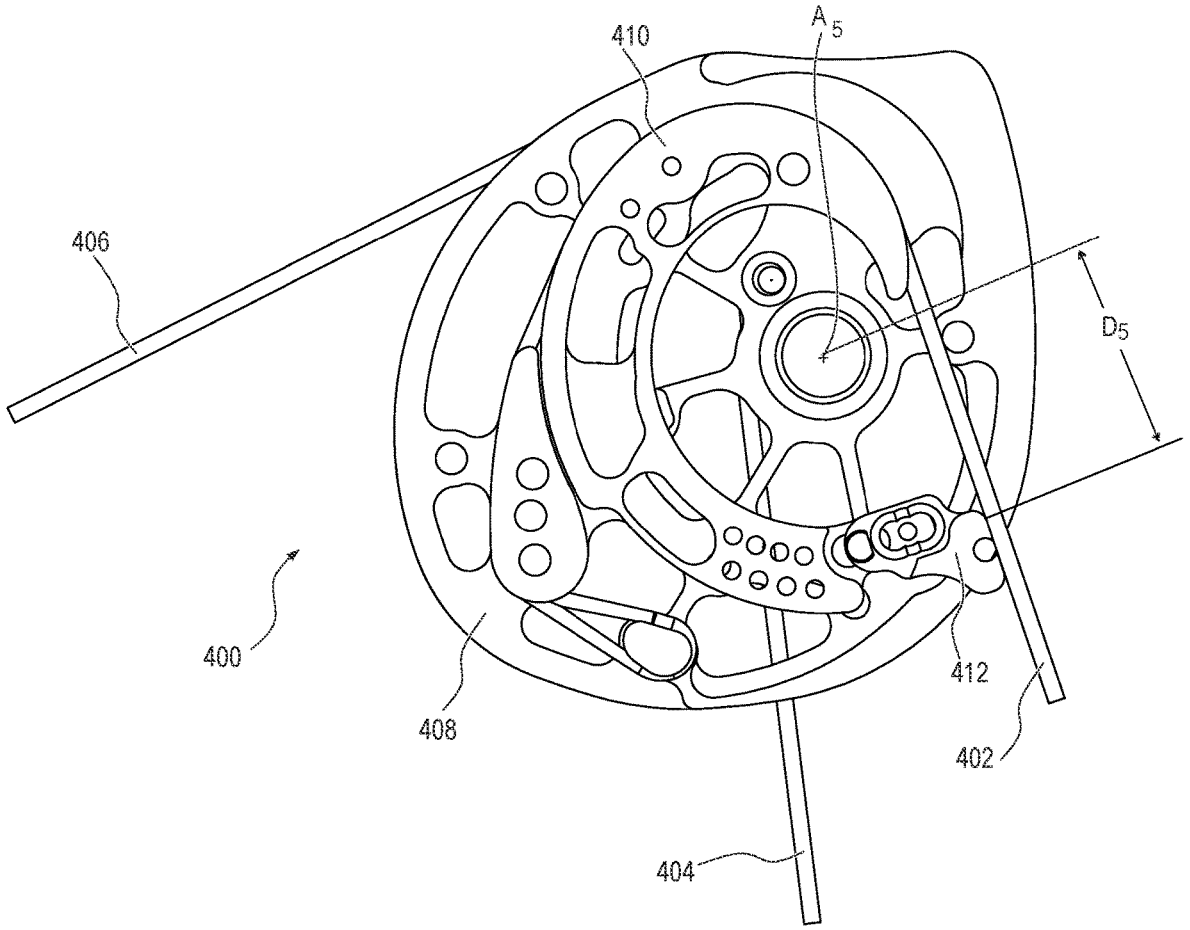
FIG. 4A is a detail side view of a cam assembly in a first configuration while the archery bow is in a fully drawn state, according to some embodiments.
Figure 4B:
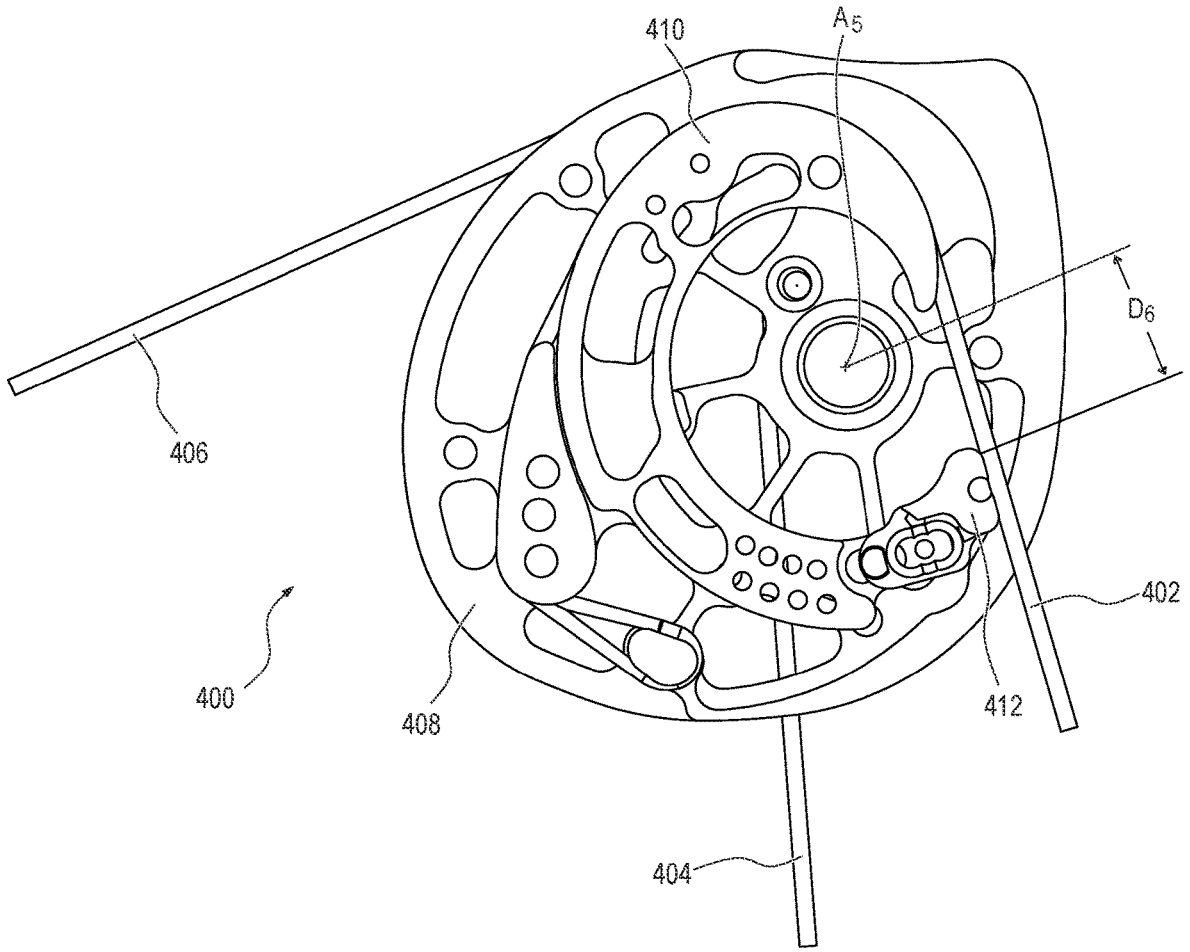
FIG. 4B is a detail side view of the cam assembly in a second configuration while the archery bow is in a fully drawn state, according to some embodiments.

FIG. 4A shows an example of an upper cam assembly 400, a first cable 402, a second cable 404, and a bowstring 406. The upper cam assembly 400 can be substantially similar to, and include some or all of, the features of the cam assemblies 200, 300. For example, the upper cam assembly 400 can include an upper cam 408, an upper module 410, and a member 412. The member 412 is affixed to the upper cam assembly 400 in a first configuration wherein the member 412 contacts the first cable 402 at a distance $D_5$ (i.e., a first distance) from an axis of rotation $A_5$ of the upper cam assembly 400. As illustrated in FIG. 4B, the member 412 can be affixed to the upper cam assembly 400 in a second configuration wherein the member 412 contacts the first cable 402 at a distance $D_6$ (i.e., a second distance) from an axis of rotation $A_5$ of the upper cam assembly 400. In some examples, the member 412 can be removed from the upper cam assembly 400, flipped or rotated by an archer, and subsequently affixed to the upper cam assembly 400 in the second configuration to vary a distance (e.g., distances $D_5$, $D_6$) the member 412 contacts the first cable 402 from the axis of rotation $A_5$. In other words, a singular component (e.g., the member 412) can be coupled to the upper cam assembly 400 in differing configurations such that the member 412 contacts the first cable 402 at differing distances (e.g., distance $D_5$ or distance $D_6$) from the axis of rotation $A_5$ relative to the particular configuration.

In some examples, the distance $D_5$ between the portion of the first cable 402 contacted by the member 412 and the axis of rotation $A_5$ can be less than about 10 mm, between about 10 mm and about 20 mm, between about 20 mm and about 30 mm, between about 40 mm and about 50 mm, or greater than about 50 mm. In some examples, the distance $D_6$ can be less than the distance $D_5$. For example, the distance $D_6$ between the portion of the first cable 402 contacted by the member 412 and the axis of rotation $A_5$ can be less than about 10 mm, between about 10 mm and about 20 mm, between about 20 mm and about 30 mm, between about 40 mm and about 50 mm, or greater than about 50 mm.

Figure 4C:
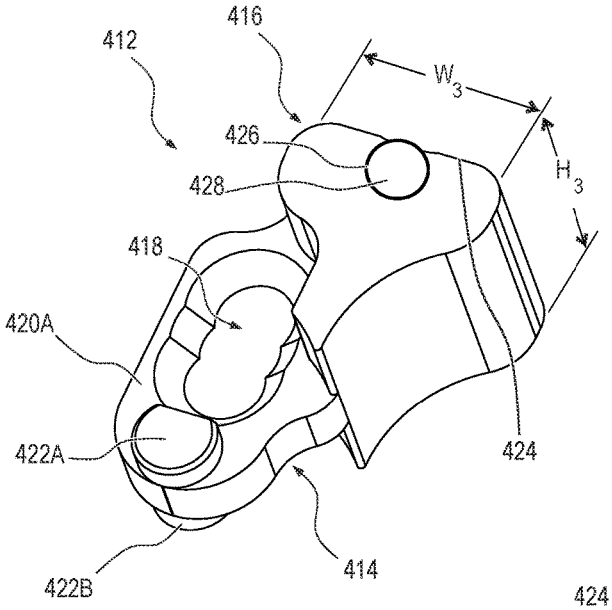
FIGS. 4C-4E are perspective side views of a member, according to some embodiments.
Figure 4D:
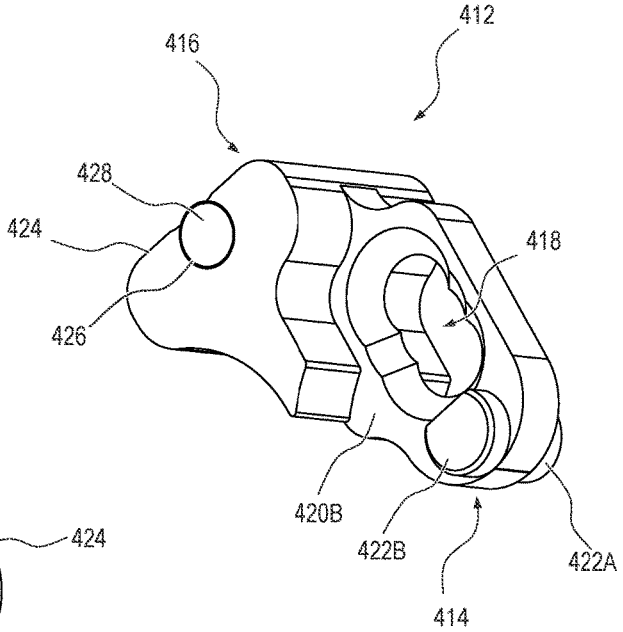
Figure 4E:
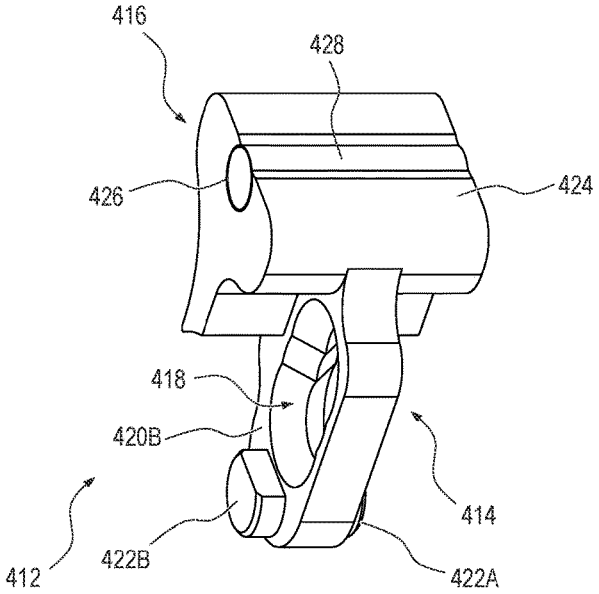

FIGS. 4C-4E show various perspective views of the member 412. In some examples, the member 412 can include a first portion 414 and a second portion 416. The first portion 414 can be configured to couple or affix to the module 410 and/or the cam 408. The second portion 416 can be configured to contact the first cable 402. The first and second portions 414, 416 can be integrally formed or otherwise coupled together by a fastener, weld, molding, adhesive, or a combination thereof. For example, the first and second portions 414, 416 can be machined or molded from a single piece of material. In some examples, the first portion 414 can be thinner than the second portion 416 to enable the member 412 to be affixed to the module 410 and/or cam 408 while still providing a relatively large contacting surface (see planar surface 424) to interface with the first cable 402.

In some examples, the first portion 414 includes the slot 418 formed between planar surfaces 420A, 420B that can interface with the module 410 or cam 408 in the first or second configurations. For example, the planar surface 420B can be oriented toward the cam 408 while the member 412 is in the first configuration and the planar surface 420A can be oriented toward the cam 408 while the member 412 is in the second configuration. The planar surfaces 420A, 420B can extend substantially parallel to one another. In some examples, the slot 418 can be chamfered, recessed, or otherwise at least partially recessed (look for other instances). In some examples, one or more protrusions 422A, 422B can extend from the planar surface 420A and/or the planar surface 420B. In some examples, while the member 412 is affixed to the module 410 and/or the cam 408, one of the protrusions 422A, 422B can extend into a cut-out, channel, or cavity defined by the module 410 and/or the cam 408. The protrusions 422A, 422B can orient the member 412 in a particular orientation that enables the member 412 to contact the first cable 402. For example, the combination of a fastener (not shown) extending through the slot 418 and one of the protrusions 422A, 422B can cause the second portion 416 of the member 412 to contact the first cable 402.

In some examples, the second portion 416 can define a planar or substantially planar surface 424 that at least partially contacts the first cable 402 while the archery bow is in a fully drawn state. The planar surface 424 can have a width $W_3$ that is less than about 5 mm, between about 5 mm and about 10 mm, between about 10 mm and about 15 mm, between about 15 mm and about 20 mm, or greater than about 20 mm. The planar surface 424 can have a height $H_3$ that is less than about 3 mm, between about 3 mm and about 6 mm, between about 6 mm and about 9 mm, between about 9 mm and about 12 mm, between about 12 mm and about 15 mm, between about 15 mm and about 18 mm, between about 18 mm and about 21 mm, between about 21 mm and about 24 mm, or greater than about 24 mm.

In some examples, the upper cam assembly 400 can include one or more dampers. For example, the planar surface 424 of the member 412 can include a channel or retaining feature 426 configured to have one or more dampers 428 disposed therein. The damper 428 can contact the first cable 402 while the archery bow is in a fully drawn state. Additionally, or alternatively, the planar surface 424 can contact the first cable 402 while the archery bow is in a fully drawn state. The damper 428 can include a flexible polymer that at least partially deforms while in contact with the first cable 402.

While FIGS. 4A-4B only reference the upper cam assembly 400, it should be understood that the archery bow can additionally, or alternatively, include a lower cam assembly having a respective member. For example, the member 412 of the upper cam assembly 400 can be a first member and a lower cam assembly of the archery bow can include a second member. In a first configuration, the second member can contact the second cable at a third distance that is substantially equivalent to the distance $D_5$. In a second configuration, the second member can contact the second cable at a fourth distance that is substantially equivalent to the distance $D_6$. In other words, the second member can be removed from the lower cam assembly, flipped or rotated by an archer, and subsequently affixed to the lower cam assembly in the second configuration to vary a distance (e.g., distances $D_5$, $D_6$) the second member contacts the second cable 404 from an axis of rotation of the lower cam assembly.

In some examples, changes may be made in the function and arrangement of archery components or products discussed without departing from the spirit and scope of the disclosure, and various embodiments may omit, substitute, or add other components or accessories as appropriate. For instance, one or more portions incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed:

1. An archery bow, comprising:
a riser;
a first limb coupled to a first end of the riser;
a second limb coupled to a second end of the riser;
a first cam assembly coupled to the first limb and rotatable about a first axis of rotation, the first cam assembly comprising:
a first cam; and
a first module;
a second cam assembly coupled to the second limb and rotatable about a second axis of rotation, the second cam assembly comprising:
a second cam; and
a second module;
a member configured to couple to the first cam assembly in a first configuration and couple to the second cam assembly in a second configuration;
a bowstring extending between the first cam assembly and the second cam assembly; and
a first cable; and
a second cable;
wherein:
in the first configuration, the member is configured to contact the first cable at a first distance from the first axis of rotation to induce a first rate at which the archery bow increases in draw weight upon achieving a minimum draw weight at a draw length; and
in the second configuration, the member is configured to contact the second cable at a second distance from the second axis of rotation to induce a second rate at which the archery bow increases the draw weight upon achieving the minimum draw weight at the draw length, the second distance being different from the first distance, and the second rate being different than the first rate.

2. The archery bow of claim 1, wherein:
the member is coupled to the first module in the first configuration; and
the member is coupled to the second module in the second configuration.

3. The archery bow of claim 2, wherein:
the member is a first member and the archery bow further comprises a second member;
the second member is coupled to the second module in the first configuration; and
the second member is coupled to the first module in the second configuration.

4. The archery bow of claim 3, wherein:
in the first configuration, the second member is configured to contact the second cable at the first distance from the second axis of rotation; and
in the second configuration, the second member is configured to contact the first cable at the second distance from the first axis of rotation.

5. The archery bow of claim 1, wherein the first distance is less than the second distance.

6. The archery bow of claim 1, wherein the first distance is greater than the second distance.

7. The archery bow of claim 1, wherein:
the first cam assembly is coupled to the first limb by a first axle defining the first axis of rotation; and
the second cam assembly is coupled to the second limb by a second axle defining the second axis of rotation.

8. The archery bow of claim 1, wherein the member is configured to be coupled to the first module or the second module by a fastener.

9. The archery bow of claim 1, wherein the member comprises a damper configured to contact the first cable or the second cable.

10. The archery bow of claim 1, wherein, in the first configuration, the member is repositionable relative to the first module along an axis that is substantially perpendicular to the first axis of rotation.

11. The archery bow of claim 10, wherein, in the second configuration, the member is repositionable relative to the second module along an axis that is substantially perpendicular to the second axis of rotation.

12. An archery bow, comprising:
a riser;
a first limb coupled to a first end of the riser;
a second limb coupled to a second end of the riser;
a cam assembly coupled to the first limb and rotatable about an axis of rotation, the cam assembly comprising:
a cam having a cam groove;
a module having a module groove; and
a member defining a slot, the member configured to be removably coupled to an exterior surface of the module in a first orientation and a second orientation opposite the first orientation
a bowstring positioned within the cam groove and extending between the first limb and the second limb, the bowstring configured to be pulled by an archer to transition the archery bow from a brace state to a fully drawn state; and
a cable positioned inside the module groove when the archery bow is in the fully drawn state;
wherein:
the member is configured to contact the cable at a first distance from the axis of rotation in the first configuration;
the member is configured to contact the cable at a second distance from the axis of rotation in the second configuration, the second distance being different from the first distance; and the member is repositionable along a length of the slot relative to the module in both the first orientation and the second orientation.

13. The archery bow of claim 12, wherein:

a first surface of the member is oriented toward the cam in the first orientation; and a second surface of the member opposite the first surface is oriented toward the cam in the second orientation, the first surface extending substantially parallel to the second surface.

14. The archery bow of claim 12, further comprising:

a second cable; and a second cam assembly coupled to the second limb and rotatable about a second axis of rotation, the second cam assembly comprising:

a second cam;

a second module; and a second member;

wherein:

in a first orientation of the second member, the second member is configured to contact the second cable at a third distance from the second axis of rotation, the third distance being substantially equivalent to the first distance; and in a second orientation of the second member, the second member is configured to contact the second cable at a fourth distance from the second axis of rotation, the fourth distance being substantially equivalent to the second distance.

15. The archery bow of claim 12, wherein the member is repositionable along an axis that extends perpendicular to the cable while the archery bow is in the fully drawn state.

16. The archery bow of claim 12, wherein the member includes indicia formed on a surface of the member, the indicia correlating to one of the first orientation or the second orientation.

17. A cam assembly for an archery bow, the cam assembly comprising:

a cam configured to couple to an archery bow and rotate about an axis of rotation;

a module coupled to the cam, the module repositionable on the cam; and a member defining a slot and a plurality of discrete positions within the slot, the member being configured to removably couple to the module in a first orientation and a second orientation opposite the first orientation, the member being positionally adjustable in the first orientation and the second orientation between the plurality of discrete positions;

wherein:

in a first configuration, the member is configured to contact a component of the archery bow at a first distance from the axis of rotation;

in a second configuration, the member is configured to contact the component at a second distance from the axis of rotation.

18. The cam assembly of claim 17, wherein the member includes a first portion attached to the module and a second portion raised relative to the first portion, the second portion being configured to contact the component.

19. The cam assembly of claim 18, wherein the first portion of the member comprises:

a planar surface to interface with the module; and a protrusion extending from the planar surface to orient the member relative to the module.

20. The cam assembly of claim 17, wherein the component is a cable, a limb, or a structure affixed to the limb.

* * * * *